US009080815B2

(12) United States Patent
Hallmann et al.

(10) Patent No.: US 9,080,815 B2
(45) Date of Patent: Jul. 14, 2015

(54) CONVERSION SET FOR A TUBE BUNDLE HEAT EXCHANGER

(75) Inventors: Mike Hallmann, Reinbek (DE); Jorg Hornig, Meerbusch (DE); Dieter Engels, Kaarst (DE)

(73) Assignee: GESMEX GMBH (DE)

( * ) Notice: Subject to any disclaimer, the term of this patent is extended or adjusted under 35 U.S.C. 154(b) by 378 days.

(21) Appl. No.: 12/999,884

(22) PCT Filed: Jun. 18, 2008

(86) PCT No.: PCT/EP2008/004905

§ 371 (c)(1),
(2), (4) Date: Mar. 1, 2011

(87) PCT Pub. No.: WO2009/152830

PCT Pub. Date: Dec. 23, 2009

(65) Prior Publication Data

US 2011/0139400 A1 Jun. 16, 2011

(51) Int. Cl.
*F28F 9/22* (2006.01)
*F28D 1/03* (2006.01)
(Continued)

(52) U.S. Cl.
CPC ..... *F28D 9/0012* (2013.01); *F28D 9/0031* (2013.01); *F28F 9/001* (2013.01); *F28F 9/005* (2013.01); *F28F 2275/06* (2013.01); *F28F 2280/02* (2013.01)

(58) Field of Classification Search
CPC ... F28D 9/0043; F28D 9/0006; F28D 9/0031; F28D 1/0325; F28F 9/0075; F28F 9/0131; F28F 3/08
USPC ..... 165/82, 145, 157, 160, 167, 178
See application file for complete search history.

(56) References Cited

U.S. PATENT DOCUMENTS 4,260,013 A * 4/1981 Sumitomo ..... 165/145
7,004,237 B2 * 2/2006 Mathur et al. ..... 165/82
(Continued)

FOREIGN PATENT DOCUMENTS

DE 102004004895 B3 6/2005
EP 0809081 A2 11/1997
(Continued)

OTHER PUBLICATIONS

English Abstract of German Patent Publication No. 10 2004 004 895 B3, published Jun. 16, 2005.
(Continued)

*Primary Examiner* — Leonard R Leo
(74) *Attorney, Agent, or Firm* — Cantor Colburn LLP

(57) ABSTRACT

The present invention relates to a conversion set for a pipe bundle heat exchanger having a cylindrical housing. Using said conversion set, existing tube bundle heat exchangers can be changed over such that the efficiency and thus the heat transfer thereof is improved, large exchange surface areas are provided, and energy costs are reduced. The conversion set can also be used in high-pressure applications for pressures above 300 bar. According to the invention, the conversion set has at least one plate heat exchanger unit for replacing the tube bundle unit, comprising at least the following components: a plate packet having at least two heat exchanger plates, each comprising at least one through hole and welded to each other in pairs along the periphery thereof or along the periphery of the through holes, two mounting plates each having at least one through hole, wherein one each of the mounting plates is arranged at each end of the plate packet and is connected to each outermost heat exchanger plate of the plate packet, and at least one tension means extending in the longitudinal axis between the mounting plates and connected to both mounting plates, so that the two mounting plates and the tension means form a cage about the plate packet, said cage absorbing the forces arising in the plate packet in the operating state of the plate heat exchanger unit, wherein the outer diameter of the plate heat exchanger unit is adapted to the inner diameter of the cylindrical housing of the tube bundle heat exchanger, and the tension means is designed as a flow director extending at least partially around the periphery of the plate packet.

18 Claims, 5 Drawing Sheets

(51) Int. Cl.
*F28D 9/00* (2006.01)
*F28F 9/00* (2006.01)

(56) References Cited

U.S. PATENT DOCUMENTS

| | | | | |
|---|---|---|---|---|
| 7,007,750 | B2 * | 3/2006 | Higashiyama | 165/178 |
| 7,204,300 | B2 * | 4/2007 | Kontu et al. | 165/157 |
| 7,347,253 | B2 * | 3/2008 | Tauren et al. | 165/167 |
| 8,453,721 | B2 * | 6/2013 | Mathur et al. | 165/157 |

FOREIGN PATENT DOCUMENTS

| | | | |
|---|---|---|---|
| EP | 1647793 | A2 | 4/2006 |
| GB | 5976 | A | 0/1915 |
| GB | 580368 | A | 9/1946 |
| WO | 95/31681 | A1 | 11/1995 |
| WO | 02/16852 | A1 | 2/2002 |

OTHER PUBLICATIONS

English Abstract of European Patent Publication No. 0 809 081 A2, published Nov. 26, 1997.

German Language Written Opinion for PCT/EP2008/004905, international filing date of Jun. 18, 2008, 5 pages.

German Language International Preliminary Examination Report for PCT/EP2008/004905, international filing date of Jun. 18, 2008, 8 pages.

International Search Report for PCT/EP2008/004905, international filing date of Jun. 18, 2008, 3 pages.

* cited by examiner

CONVERSION SET FOR A TUBE BUNDLE HEAT EXCHANGER

CROSS-REFERENCE TO RELATED APPLICATION

This application is a U.S. national stage application of International Application No. PCT/EP2008/004905, which has an international filing date of Jun. 18, 2008.

BACKGROUND OF THE INVENTION

1. Field of the Invention

The invention relates to a conversion set for a tube bundle heat exchanger having a cylindrical housing.

2. Description of Related Art

Tube bundle heat exchangers are often used in process plants in industry. A tube bundle heat exchanger normally consists of an outer jacket or an outer housing and a tube bundle located in the interior, i.e., arranged in the housing. The exchange of the process heat takes place between these two separate components. The heat from a first hot heat transfer medium is absorbed by a second heat transfer medium which is to be heated up, by means of which the energy transfer is realised. Tube bundle heat exchangers are very strong and can therefore be used for applications with high pressures, for example in hydrogenation plants in which a pressure of over 300 bar may prevail. The pressure differences arising with these applications and occurring between the heat transfer medium flowing in the housing and the second heat transfer medium which flows in the tubes previously only permitted the use of tube bundle heat exchangers.

A disadvantage with tube bundle heat exchangers is that due to the laminar flow in the tubes and the relatively thick tube walls, which may be 2 to 3 mm thick, only low heat transmission coefficients and thus a low efficiency of the tube bundle heat exchangers can be achieved. Consequently, large heat exchange surface areas are needed leading to relatively large tube bundle heat exchangers which are heavy and therefore also very expensive. In addition, the energy costs of the plants increase due to the incomplete heat transfer from the hot heat transfer medium to the heat transfer medium to be heated up.

Therefore, the object of the invention is to convert existing tube bundle heat exchangers such that the above disadvantages are avoided and an improved heat transfer and large heat exchange surface areas are facilitated at low costs, whereby these converted heat exchangers are also to be used in the high pressure range, i.e., at pressures over 300 bar.

BRIEF SUMMARY OF THE INVENTION

For this purpose according to the invention provision is made that the conversion set has at least one plate heat exchanger unit for replacing the tube bundle unit comprising at least the following components:

a plate packet having at least two heat exchanger plates, each comprising at least one through hole and welded to each other in pairs along the periphery thereof or along the periphery of the through holes, two mounting plates each having at least one through hole, whereby in each case one of the mounting plates is arranged at each end of the plate packet and is connected to each outermost heat exchanger plate of the plate packet, and at least one tension means flow director extending in the longitudinal direction between the mounting plates and connected to both mounting plates, so that the two mounting plates and the tension means flow director form a cage about the plate packet, said cage absorbing the forces arising in the plate packet in the operating state of the plate heat exchanger unit, whereby the outer diameter of the plate heat exchanger unit is adapted to the inner diameter of the cylindrical housing of the tube bundle heat exchanger, and the tension means flow director, in addition to serving as part of the cape, is designed as a flow director extending at least partially around the periphery of the plate packet.

Due to the cage construction of the two mounting plates and the tension means flow director which is arranged between and connected to the two mounting plates, and which is also formed as a flow director, the plate heat exchanger unit can absorb the forces arising during the operation of the heat exchanger. In this way the forcing apart of the heat exchanger plates of the plate packet under pressure can be avoided. Consequently, the plate heat exchanger unit as such can be used in existing tube bundle heat exchanger housings and the normal tube bundles can be replaced. The pressure jacket of conventional plate heat exchanger units, which normally absorbs the forces occurring, is thus no longer needed. In this way a simple construction of the plate heat exchanger unit in the existing housing of the tube bundle heat exchanger is possible. The modified tube bundle heat exchanger thus facilitates an improved thermal transfer, because with the aid of the heat exchanger plates a larger exchange surface area is obtained and due to the lower wall thickness of the heat exchanger plates, normally 0.6 to 1 mm, an improved heat transfer is possible. In this way it is also possible to save on the plant energy costs. With the aid of the plate heat exchanger unit a variation in the heat transfer surface area of the existing heat exchanger is also possible in that the diameter of the heat exchanger plates used and the number of the heat exchanger plates used are selected accordingly. In this way an enlargement, reduction or no change of the heat transfer surface area is possible in comparison to the originally existing tube bundle heat exchanger.

Due to the special formation of the tension means as a flow director, the tension means flow director has a double function. Firstly, as described above, it absorbs forces occurring in the operation of the heat exchanger and secondly it prevents the occurrence of bypass flows in the housing of the tube bundle heat exchanger. Thus the plate heat exchanger unit has only a few components and can be relatively easily manufactured. The tension means flow director is sometimes below referred to simply as the "flow director" or "tension means", but it should be understood that at all times it serves the dual function of both a tension means and a flow director.

Admittedly, a plate heat exchanger unit, which is also suitable for high pressure applications, is already known from DE 10 2004 004 895 B3. However, this publication does not define what is meant by high pressure. This plate heat exchanger comprises a plate packet which is used in a pressure-resistant housing, whereby the plate packet and the housing are matched to one another. The plate packet has heat exchanger plates joined together and is bounded on both sides by packet clamping plates. The plate packet is clamped by at least four clamping bolts which extend between the packet clamping plates and are welded to them. On two sides of the plate packet side panels are fitted which are located on the periphery of the plate packet and have U-shaped angled portions at their ends, which are supported to seal against the internal diameter of the housing so that the heat transfer medium on the jacket side cannot flow past at the side between the housing and the plate packet, but instead has to flow between the heat exchanger plates. In order to facilitate the introduction of the plate packet into the housing the side panels must not be formed too thick so that the angled portions can yield. When the plate packet is inserted into the housing, the angled portions are clamped between the plate packet and the housing and provide sealing. Due to the small thickness, the side panels cannot absorb any forces, but instead have only a flow-directing and sealing function. As already explained, the level of the operating pressure is not defined. It can be assumed however that the side panels for high pressure applications deform under a pressure of over 250 bar, such as for example is the case in hydrogenation plants, and also that the flow direction tasks can no longer be fulfilled.

In a preferred embodiment of the invention provision is made that the mounting plates are essentially circular and have in each case at their edge a recess for flow direction of a heat transfer medium, situated on the housing side, flowing through the housing of the tube bundle heat exchanger. Due to the recess in the mounting plates the flow of the heat transfer medium on the housing side is directed into the desired direction. If the heat exchanger is realised as a single-pass construction, then the recesses of the two mounting plates of a plate heat exchanger unit are arranged on the oppositely situated sides of the plate packet, so that the heat transfer medium on the housing side flows in on the side adjacent to the heat exchanger plates, then through the plate packet and out on the oppositely situated side. However, different flow guidance is also possible, in particular a multi-pass flow guidance is conceivable.

Preferably, provision can be made that the recess on the edge of the mounting plate is in the shape of a ring segment. In this way a very simple embodiment of the mounting plate is facilitated.

In a particularly preferred embodiment provision can be made that the recess in the shape of a ring segment in each mounting plate extends over an angle of approximately 90°. Thus an included angle of 90° is obtained through which the heat transfer medium on the jacket or housing side flows into the plate packet which is well suited to very many applications.

In a further variant, provision can be made that the external diameter of the mounting plates is larger than the external diameter of the heat exchanger plates of the plate packet and corresponds approximately to the internal diameter of the housing of the tube bundle heat exchanger. Thus the mounting plates are situated with the large part of their periphery on the inner side of the housing. Between the recesses of the mounting plates and the inner side of the housing a flow path is formed for the heat transfer medium on the housing side. Since the diameter of the mounting plates approximately corresponds to the internal diameter of the housing, the heat exchanger plate unit can be simply introduced into the existing housing. Good centering of the plate heat exchanger unit in the housing is possible. In addition a sealing effect is achieved between the mounting plates and the housing so that the heat transfer medium on the housing side principally flows through the recesses in the mounting plates and thus the desired flow guidance is achieved.

In a further embodiment provision can be made that the central axis of the at least one through hole in each mounting plate runs obliquely and at an angle to the central axis of the corresponding mounting plate so that the opening of the through hole on the inner side of the mounting plate is arranged closer to the edge of the mounting plate than the opening of the through hole on the outer side of the mounting plate. In this way the situation is achieved in that on the outer side of each mounting plate more space is available for the connection to another plate unit or to the existing connections for the tube bundle heat exchanger.

Also provision can be made that one inner side of the at least one flow director is located on the external diameter of the plate packet and an outer side of the at least one flow director terminates with the external diameter of the mounting plates. The at least one flow director is thus formed such that it fills out the space between the plate packet and the inner side of the housing so that a bypass flow past the side of the plate packet is blocked. In addition the at least one flow director is similarly supported on the inner side of the housing, by means of which an improved positioning of the plate heat exchanger unit in the housing is facilitated.

In a particularly preferred embodiment provision is made that the flow director has a thickness of at least 5 mm. In this way it is ensured that the flow director has the desired strength to absorb the arising tensile forces which occur during use at high pressure with a pressure of at least 300 bar, for example in hydrogenation plants.

In order to facilitate a more stable cage construction provision can be made that at least one further flow director is provided whereby the two flow directors are arranged on oppositely situated sides of the plate packet. In this way two flow channels are formed for the heat transfer medium on the housing side—a feed channel and a discharge channel.

In a further variant provision can be made that on the through hole of each mounting plate a first flange is arranged and a further flange is provided on each mounting plate. Due to the flanges a very simple connection of the plate heat exchanger unit to the existing connections of the tube bundle heat exchanger is possible for the feeding and discharge of heat transfer media. In addition a plurality of plate heat exchanger units can be connected together in this way. The flange joints are easily released so that repairs or maintenance on the plate heat exchanger unit are easily possible or the plate heat exchanger unit can be easily replaced.

However provision can be made that on the through hole of each mounting plate a first pipe weld end is arranged and a further pipe weld end is provided on each mounting plate. The pipe weld ends can be joined to existing connections of the tube bundle heat exchanger for feeding and discharging heat transfer media in that a welded joint is applied. In this way a reliable connection is possible and no seals, such as for example with a flange joint, are needed.

Expediently, provision can be made that a support plate is arranged on the inner side of each mounting plate and each mounting plate is connected by means of the support plate to the respective outer heat exchanger plate of the plate packet. In this way the manufacture of the plate packet is simplified and an improved connection between the relatively thick mounting plate and the very thin heat exchanger plate can be facilitated.

In another further variant provision can be made that the conversion set comprises at least two plate heat exchanger units, which are each connected to one another by means of the flanges or the pipe weld ends, whereby the mounting plates and the flanges or pipe weld ends are designed such that they can support the weight of the plate heat exchanger units. In this way a plurality of plate heat exchanger units can be employed in the existing tube bundle heat exchanger housing. The plate heat exchanger units can then be formed with smaller heat exchange surface areas, i.e., with a smaller number of heat exchanger plates by means of which the individual plate heat exchanger units have a higher stability. Due to the connection of each of the individual plate heat exchanger units via two flanges or pipe weld ends, the plate heat exchanger units are supported by each other at two points, by means of which buckling and thus jamming of the plate heat exchanger units in the housing is avoided. Through an appropriate arrangement of the mounting plates of the individual plate heat exchanger units a good flow guidance of the heat transfer medium on the housing side is possible. The heat exchange surface area of the existing heat exchanger can be easily increased or reduced by adding or removing individual plate heat exchanger units.

In a particularly preferred embodiment provision is made that the housing of the tube bundle heat exchanger is a high pressure housing for a pressure range of up to over 300 bar. In this way the use of the heat exchanger in a high pressure plant is possible.

BRIEF DESCRIPTION OF THE SEVERAL VIEWS OF THE DRAWINGS

In the following, embodiments of the invention are explained in more detail based on a drawing. The following are shown.

DETAILED DESCRIPTION OF THE INVENTION

Figure 1:
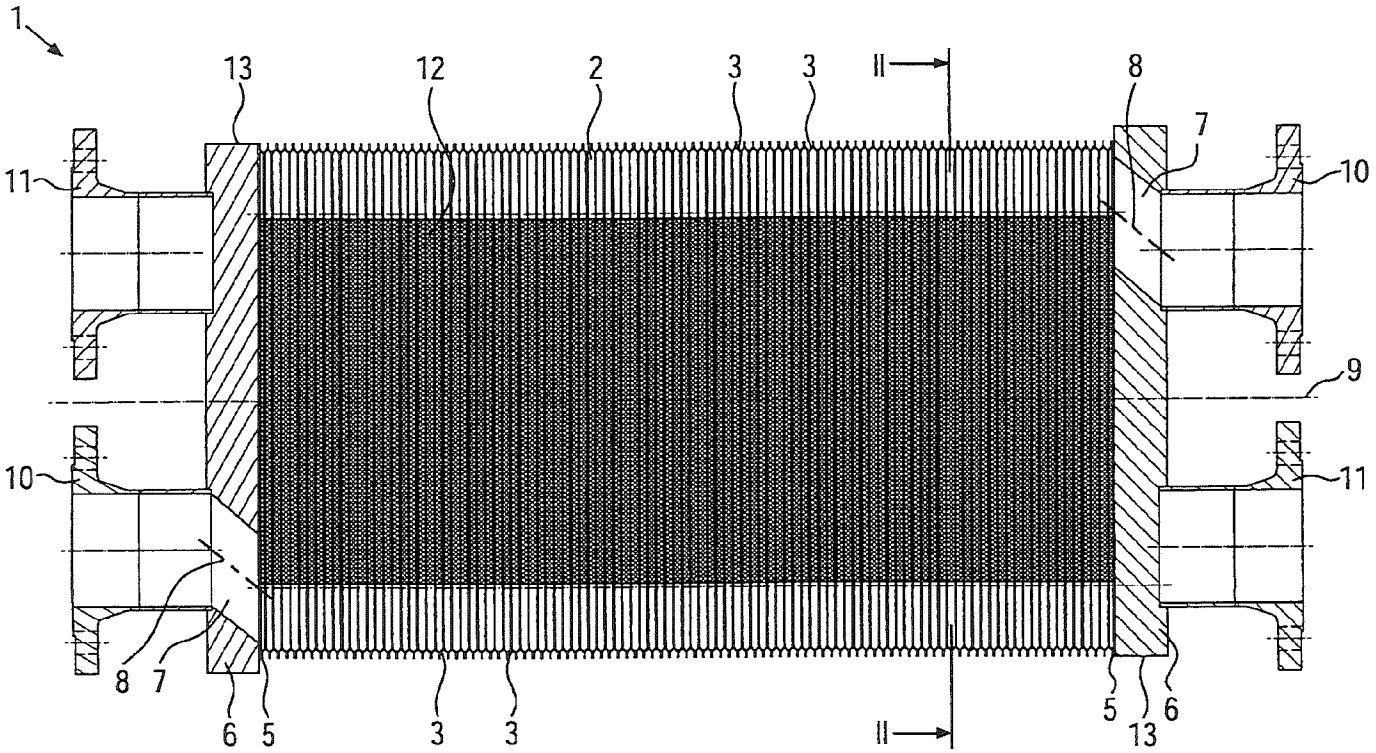
FIG. 1 is a side view of a partially sectioned plate heat exchanger unit.

FIG. 1 illustrates a side view of a plate heat exchanger unit 1. The plate heat exchanger unit 1 comprises a plate packet 2 which comprises at least two heat exchanger plates 3. In the present case the plate packet 2 comprises a large number of heat exchanger plates 3. Each heat exchanger plate 3 has at least one through hole 4, preferably two through holes 4. This can be seen for example in FIG. 2. In each case two heat exchanger plates 3 are joined together along their through holes 4, preferably by welding. The plate pairs thus created are welded together along the periphery of the heat exchanger plates 3 so that the plate packet 2 is produced. The thickness of the heat exchanger plates 3 is about 0.6 to approximately 1 mm. It is also conceivable however to use thicker or thinner heat exchanger plates.

At both ends of the plate packet 2 in each case the outer heat exchanger plate 3 is joined to a support plate 5, preferably by welding. The heat exchanger plates 3 are preferably circular, the support plates 5 are annular and exhibit the same external diameter as the heat exchanger plates 3. The support plates 5 are thicker than the heat exchanger plates 3.

The support plates 5 are in turn joined to the mounting plates 6. Also the joint between the support plates 5 and the mounting plates 6 is preferably a welded joint.

The mounting plates 6 have a greater thickness than the support plates 5 and thus a substantially greater thickness than the heat exchanger plates 3. Since the thickness of the support plates 5 is between the thickness of the mounting plates 6 and the thickness of the heat exchanger plates 3, in each case good welded joints between the heat exchanger plates 3 and the support plates 5 and between the support plates 5 and the mounting plates 6 are possible.

Each of the mounting plates 6 has at least one through hole 7. As already described, the heat exchanger plates 3 are welded together in pairs along their through holes 4. The through holes 7 of the mounting plates 6 are connected to the through hole 4 of the heat exchanger plates 3 arranged adjacent to the mounting plates 6 so that a passage channel through these through holes 4 and 7 is formed for a heat transfer medium flowing through the plate packet 2, i.e., on the plate side.

As can be seen from FIG. 1, the central axis 8 of each through hole 7 of each mounting plate 6 runs obliquely and forms an angle with the central axis 9 of the plate heat exchanger unit 1 and thus also with the central axis of the corresponding mounting plate 6. Thus the openings of the through holes 7 on the inner side of each mounting plate 6, i.e., on the side of the mounting plate 6 which is facing the plate packet 2, are arranged further on the edge of the mounting plate 6 than the openings of the through holes 7 of the mounting plate 6 which are formed on the outer side of the mounting plate 6.

As can be exemplarily seen from FIG. 1, the through holes 7 of the two mounting plates 6 of a plate heat exchanger unit 1 are arranged on oppositely situated sides of the plate packet 2 so that the flow of the heat transfer medium on the plate side in the plate packet 2 is diverted. In order to achieve a good thermal transfer between the heat transfer medium on the plate side and a heat transfer medium on the housing side, the heat exchanger plates 3 preferably have impressions. Through these impressions a turbulent flow of the heat transfer media is produced which improves the thermal transfer.

Figure 6:
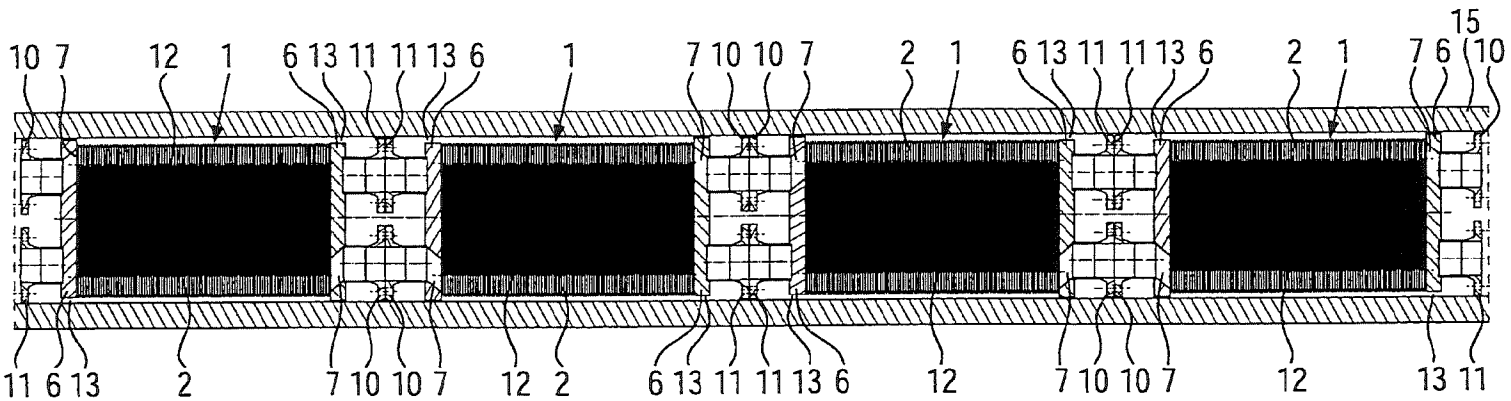
FIG. 6 is a pressure jacket of a tube bundle heat exchanger with the plate heat exchanger units used therein.

The first flanges 10 are fitted to the through holes 7 of the mounting plates 6. Preferably the first flanges 10 are welded to the mounting plates 6. Furthermore, to each mounting plate 6 a second flange 11 is fitted which is arranged symmetrically to the first flange 10 which is connected to the through hole 7 of the mounting plate 6. The flanges 10, 11 are arranged on the outer side of the mounting plates 6. The external diameter of the mounting plates 6 is larger than the external diameter of the heat exchanger plates 3 and the external diameter of the support plates 5. Preferably the external diameter of the mounting plates 6 corresponds approximately to, or is slightly smaller than, the internal diameter of the housing of the tube bundle heat exchanger into which the plate heat exchanger unit 1 is inserted. The housing 15 is shown in FIG. 6 but is not shown in the other Figures. The mounting plates 6 are essentially circular, but have a recess 13 at a point on their periphery at the edge. In FIG. 1 the recess 13 of the left mounting plate 6 is arranged on the upper side of the plate heat exchanger unit and the right mounting plate 6 is arranged such that its recess 13 points downwards.

At least one flow director 12 extends between the two mounting plates 6. The flow director 12 is joined to the two mounting plates 6, preferentially by welding. Thus, the at least one flow director 12 and the two mounting plates 6 form a cage construction for the plate packet 2. The flow director 12 is formed as a tension means so that the flow director 12 can absorb tensile forces and transfer them to the mounting plates 6. During operation of the plate heat exchanger unit 1*a* first heat transfer medium flows through the plate packet 2. In this way pressure is exerted on the heat exchanger plates 3, forcing them apart. The forces thus arising are absorbed by the flow director 12 and the mounting plates 6 so that the plate heat exchanger unit 1 can also be operated under pressure without a separate, pressure-resistant heat exchanger housing being needed.

Figure 2:
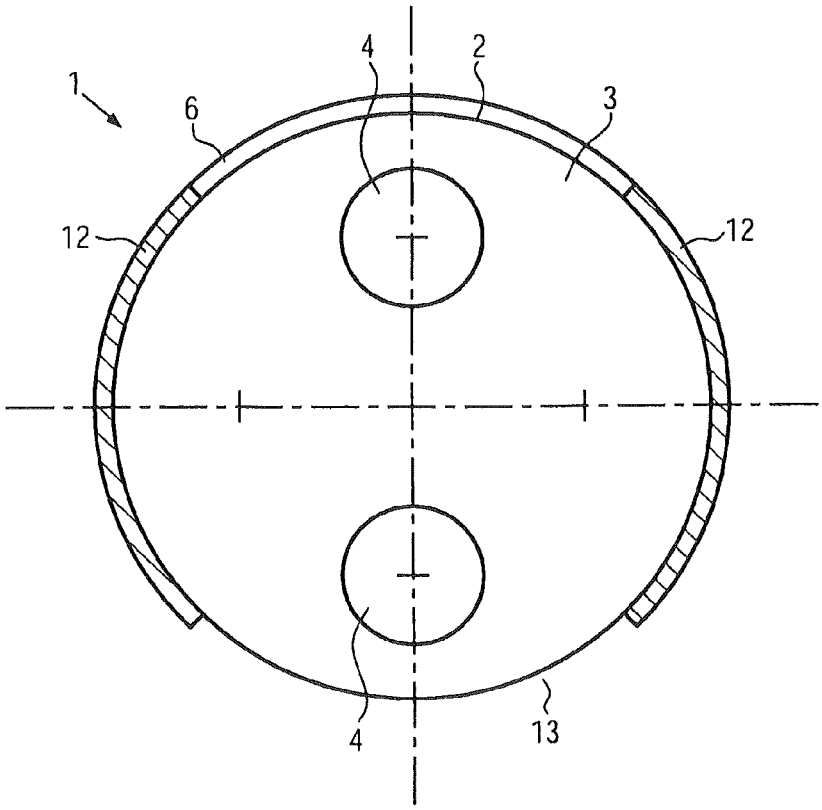
FIG. 2 is a section through the plate heat exchanger unit from FIG. 1 along the line II-II.

FIG. 2 illustrates a section through the plate heat exchanger unit 1 from FIG. 1 along the line II-II. As illustrated, each heat exchanger plate 3 has at least one through hole 4, preferably two through holes 4. The heat exchanger plates 3 are joined together in pairs along the through holes 4, preferably by welding, so that a first flow channel is produced in the interior of the plate packet 2. As illustrated in FIG. 2, the plate heat exchanger unit 1 has two flow directors 12 which are arranged mutually symmetrically on two sides of the plate packet 2. Each flow director 12 extends over part of the periphery of the plate packet 2, whereby the inner side of the flow director 12 is located on the external diameter of the plate packet 2 and the outer side preferably terminates with the external diameter of the mounting plate 6. Thus the heat transfer medium on the housing side in the region in which the flow directors 12 are arranged does not flow to the side past the plate packet 2. The flow directors 12 are joined to the two mounting plates 6 such that the recesses 13 in the mounting plates 6 are arranged there where no flow directors 12 are situated.

Figure 3:
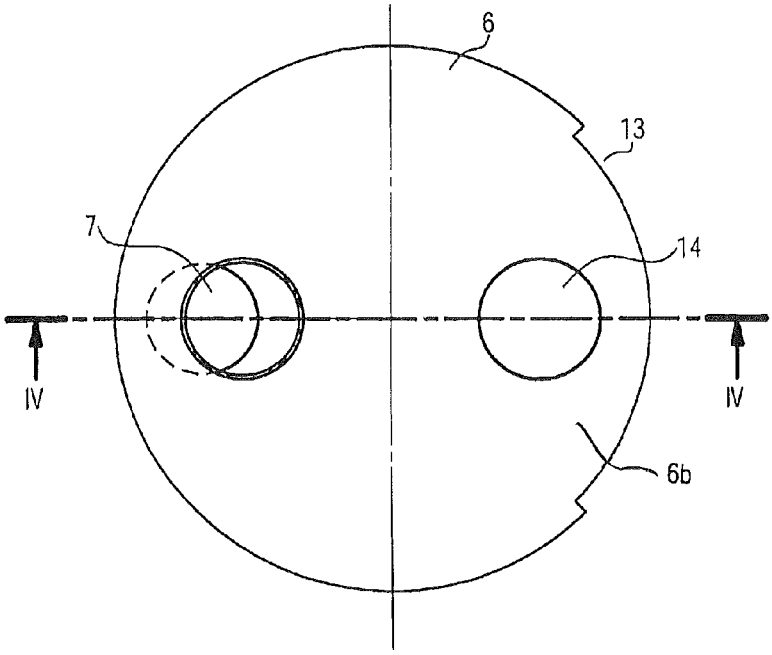
FIG. 3 is a plan view onto a mounting plate of the plate heat exchanger unit from FIG. 1.

In FIG. 3 a plan view of a mounting plate 6 is illustrated. As already described, each mounting plate 6 is essentially circular, whereby the external diameter of each mounting plate 6 is matched to the internal diameter of the housing of the tube bundle heat exchanger into which the plate heat exchanger unit 1 is to be inserted. At its edge each mounting plate 6 has a recess 13. This recess 13 essentially has the shape of a ring segment. It is also conceivable however to form the recess 13 differently. Preferably, the recess 13 in the shape of a ring segment extends over an angle of 90°. It is also possible that the recess 13 extends over a smaller angle or a larger angle.

Figure 4:
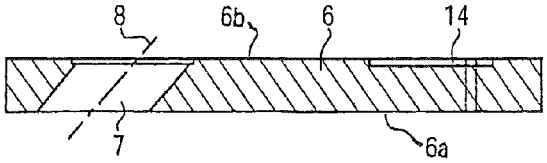
FIG. 4 is a section through the mounting plate from FIG. 3 along the line IV-IV.

Each mounting plate 6 also has a through hole 7 with, as best seen in FIG. 4 an oblique central axis, whereby the opening of the through hole 7 is located on the inner side 6*a* of the mounting plate 6 closer to the edge of the mounting plate 6 than the opening of the through hole 7 on the outer side 6*b* of the mounting plate 6. Inner side 6*a* is the side of each mounting plate 6 which faces the plate packet 2 and the outer side 6*b* of each mounting plate 6 is correspondingly the side of the mounting plate 6 facing away from the plate packet 2. A circular indentation 14 in which a flange or a pipe weld end can be inserted is arranged symmetrically with respect to the through hole 7 on the outer side 6*b* of the mounting plate 6.

FIG. 4 illustrates a section through the mounting plate 6 along the line IV-IV from FIG. 3. In this drawing it can again be clearly seen that the central axis 8 of the through hole 7 of each mounting plate 6 runs obliquely. In this way more space is available on the outer side 6*b* of the mounting plate 6 for the attachment of a flange or a similar device. As noted above, a second circular indentation 14 for the attachment of a further flange or similar device is provided in each mounting plate 6.

This indentation 14 however does not extend through the total thickness of the mounting plate 6.

Depending on the design rating, each plate heat exchanger unit 1 is pressure-resistant to 25 bar or 40 bar, because the mounting plates 6 and the at least one flow director 12 or the two flow directors 12 form a cage around the plate packet 2 and thus prevent the heat exchanger plates 3 being forced apart when they are subjected to pressure. Therefore each plate heat exchanger unit 1 is suitable for use in existing housings, for example, the housings of tube bundle heat exchangers to replace the tube bundle unit originally contained in the housing. Tube bundle heat exchangers are normally relatively long so that the desired heat transfer surface area is obtained. It is therefore possible to join together a plurality of plate heat exchanger units 1 and to insert the thus produced assembly into an existing jacket or into an existing housing of a tube bundle heat exchanger.

Figure 5:
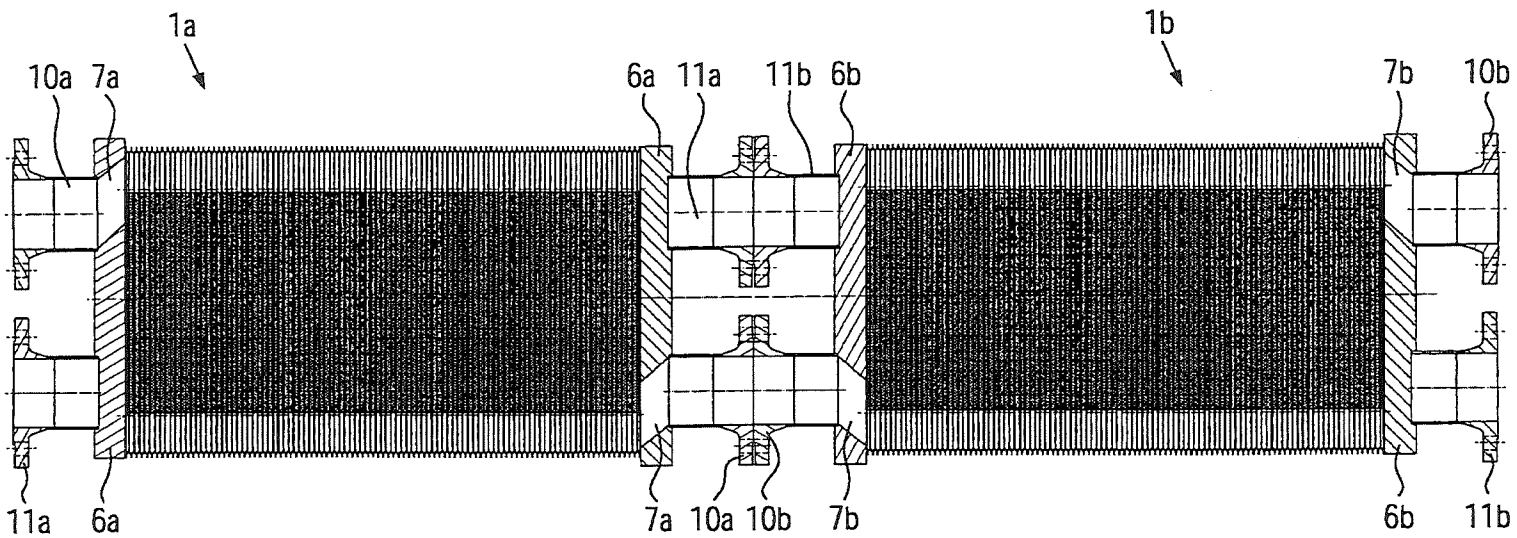
FIG. 5 is a two plate heat exchanger units connected together.

In FIG. 5 the connection of two plate heat exchanger units 1*a*, 1*b* described above is illustrated. As already described, each mounting plate 6*a*, 6*b* of a plate heat exchanger unit 1*a*, 1*b* has at least one through hole 7*a*, 7*b* which is joined to a flange 10*a*, 10*b*. In addition, on each mounting plate 6*a*, 6*b* a second flange 11*a*, 11*b* is provided which is symmetrically arranged with respect to the first flange 10*a*, 10*b*.

Both plate heat exchanger units 1*a*, 1*b* are now arranged such that in each case two first flanges 10*a*, 10*b* and two second flanges 11*a*, 11*b* are oppositely situated. In this way the passage channel of the first plate heat exchanger unit 1*a* formed by the through holes 7*a* of the mounting plates 6*a* and by the through holes 4*a* of the heat exchanger plates 3*a* is joined to the corresponding passage channel of the second plate heat exchanger unit 1*b*. Also the two second flanges 11*a*, 11*b*, which are additionally arranged on the mounting plates 6*a*, 6*b*, are arranged mutually oppositely situated. The pairs of flanges 10*a*, 10*b*, 11*a*, 11*b* are joined together, preferably by a screwed joint. A seal is arranged at least between the two first flanges 10*a*, 10*b* so that a sealed joint is produced. Preferably the plate heat exchanger units 1*a*, 1*b* are inserted vertically into the plate heat exchanger housing. Thus the upper plate heat exchanger unit 1*b* is supported via the two pairs of flanges 10*a*, 10*b*, 11*a*, 11*b* on the lower plate heat exchanger unit 1*a*. Due to the symmetrical arrangement of the flanges 10*a*, 11*a*, 10*b*, 11*b* a uniform support is ensured and buckling of the upper plate heat exchanger unit 1*b* is prevented.

In FIG. 6 a section through a housing 15 of a tube bundle heat exchanger is illustrated, in which the plate heat exchanger units 1 described above are inserted joined together. The plate heat exchanger units 1 are, as illustrated in FIG. 5, connected together via their flanges 10, 11. It is also possible to attach pipe weld ends to the mounting plates 6 instead of the flanges and to join the plate heat exchanger units 1 together using the pipe weld ends. In doing this the pipe weld ends of a first plate heat exchanger unit 1 are in each case welded to the pipe weld ends of a second plate heat exchanger unit 1.

As already described, the plate heat exchanger units 1 are joined together such that the through holes 7 of the mounting plates 6 and the through holes 4 in the heat exchanger plates 3 form a first flow channel through which a first heat transfer medium flows on the plate side. The flange 10 of the first and lowermost plate heat exchanger unit 1 is connected to the existing feed of the tube bundle heat exchanger for the first heat transfer medium. The flange 10 of the last and uppermost plate heat exchanger unit 1 is connected to the existing connection of the tube bundle heat exchanger for the outflow of the first heat transfer medium. A second flow channel for a second heat transfer medium on the housing side is formed by the inner side of the housing 15 of the tube bundle heat exchanger and the outer side of the plate packets 2 of the plate heat exchanger units 1. This second heat transfer medium is passed through the existing connections of the tube bundle heat exchanger into the housing 15 and passed out from it.

As already described, the mounting plates 6 of each plate heat exchanger unit 1 are essentially circular, whereby their diameter is matched to the internal diameter of the housing 15 of the tube bundle heat exchanger. Preferably the external diameter of each mounting plate 6 essentially corresponds to the internal diameter of the housing 15 of the tube bundle heat exchanger or is slightly smaller than the internal diameter of the housing 15. If the plate heat exchanger units 1 are introduced into the housing 15 of the tube bundle heat exchanger then the mounting plates 6 are located on the inner side of the housing 15. In this way the plate heat exchanger units 1 are centered and supported in the housing 15 and the insertion is simplified.

A flow channel for the second heat transfer medium flowing through the housing 15 is formed by the recesses 13, in the shape of ring segments, in the mounting plates 6. The heat transfer medium on the housing side is introduced into the housing 15 at or adjacent to a face side of the housing 15 of the tube bundle heat exchanger. Since the mounting plate 6 of the first plate heat exchanger unit 1 is located with its periphery on the housing 15, the heat transfer medium can only flow through the recess 13 past the mounting plate 6. The heat transfer medium on the housing side then flows through the plate packet 2, by means of which a heat transfer takes place between the heat transfer medium on the housing side and the heat transfer medium flowing through the plate packet 2.

The second mounting plate 6 of each plate heat exchanger unit 1 is preferably arranged such that it is turned by 180° with respect to the first mounting plate 6 so that the recess 13 of the first mounting plate 6 and the recess 13 of the second mounting plate 6 are arranged on mutually oppositely situated sides of the plate packet 2. Thus the heat transfer medium on the housing side enters the housing 15 on one side of the plate packet 2, flows through the plate packet 2, exits on the mutually oppositely situated side where it is passed on via the recess 13 of the second mounting plate 6 into the following plate heat exchanger unit 1.

Since the flow directors 12 are arranged on the two sides of each plate packet 2, the heat transfer medium on the housing side cannot flow to the side past the plate packet 2, but must instead flow through the plate packet 2. The flow directors 12 thus have two functions. Firstly they prevent bypass flows forming in the heat transfer medium on the housing side which pass along the side of the plate packet 2 on the inner side of the housing 15. Secondly the flow directors 12 are formed to resist tension, so that they can absorb tensile forces produced during operation of the plate heat exchanger unit 1 and can transfer them to the mounting plates 6. Preferably the flow directors 12 have a thickness of at least 5 mm so that the desired strength is achieved.

Due to the cage construction of the plate heat exchanger units 1 they can also be used for the high pressure range, i.e., for pressure ranges from 150 to above 300 bar depending on the design rating. The plate heat exchanger units 1 can therefore be used in the high pressure jackets of tube bundle heat exchangers which are employed for example in hydrogenation plants. Preferably the housing 15 of the tube bundle heat exchanger is rated such that it is pressure-resistant up to at least 300 bar. The differential pressure between the heat transfer medium on the housing side and the heat transfer medium on the plate side is normally in the region of about 25 bar.

In FIG. 6 the individual plate heat exchanger units 1 are connected together in series. However, provision can be made that the plate heat exchanger units 1 are connected in parallel. For this purpose further pipes must be provided in the interior of the housing 15 of the tube bundle heat exchanger. A combination of a series and parallel configuration of the individual plate heat exchanger units 1 is possible.

The diameter of the mounting plates, the heat exchanger plates and the support plates can be adapted to existing housing internal diameters. As already described, the external diameter of the mounting plates 6 preferably corresponds to the internal diameter of the housing 15 and the diameter of the heat exchanger plates 3 can be smaller by any amount than the internal diameter of the housing 15. The heat transfer surface area can be varied by changing the diameter of the heat exchanger plates 3. The heat transfer surface area of the plate heat exchanger units 1 can also be changed through the number of the heat exchanger plates in the plate packet of the plate heat exchanger unit. It is also possible to use only a low number of plate heat exchanger units in an existing housing so that when replacing the tube bundle unit by one or a plurality of plate heat exchanger units the heat exchange surface area of an existing tube bundle heat exchanger can be reduced, enlarged or kept constant.

In FIG. 6 the face side covers of the tube bundle heat exchanger are not illustrated. The housing 15 is however closed off on the face side with the existing covers already provided for the tube bundle heat exchanger. Normally tube bundle heat exchangers are operated vertically. The plate heat exchanger units 1 arranged in the housing 15 are then supported by one another via the flanges 10 or 11. Normally the lowermost plate heat exchanger unit 1 is attached to a support. The other plate heat exchanger units are supported on the lowermost plate heat exchanger unit and are not additionally attached so that thermal expansion is facilitated. However it is conceivable that the plate heat exchanger units are attached in a different manner in the housing 15.

What is claimed is:

1. Conversion set for a tube bundle heat exchanger having a cylindrical housing, which housing has an inner diameter and is configured to receive therein a tube bundle unit, the conversion set comprising at least one plate heat exchanger unit for replacing such tube bundle unit, the plate heat exchanger unit having an outer diameter configured to fit within the inner diameter of the cylindrical housing and comprising at least the following components:

(a) a plate packet having at least two heat exchanger plates, each comprising at least one through hole and welded to each other in pairs along the periphery thereof or along the periphery of the through holes, (b) a cage comprised of two essentially circular mounting plates joined to at least one tension means flow director which extends in the longitudinal direction between the two mounting plates, the tension means flow director comprising a single structure which is configured to extend at least partially around the periphery of the plate packet and serves both to secure the two mounting plates to each other and to prevent bypass flow of a heat exchange medium past the plate packet, wherein an inner side of the at least one tension means flow director is located on the external diameter of the plate packet and an outer side of the at least one tension means flow director terminates along the outer diameter of the mounting plates, the two mounting plates each having at least one through hole and a recess in the shape of a ring segment at its edge for diverting the flow of a heat transfer medium flowing through the housing of the tube bundle heat exchanger, wherein the recess extends over an angle of approx. 90°, and wherein in each case one of the mounting plates is arranged at each end of the plate packet and is connected to each outermost heat exchanger plate of the plate packet, wherein the at least one tension means flow director is located on either side of the recess, and wherein the cage is disposed about the plate packet and is by itself capable of absorbing the forces arising in the plate packet in the operating state of the plate heat exchanger unit to thereby preclude such forces from forcing apart the heat exchanger plates.

2. Conversion set according to claim 1, characterised in that the external diameter of the mounting plates is greater than the external diameter of the heat exchanger plates of the plate packet and corresponds approximately to the internal diameter of the housing of the tube bundle heat exchanger.

3. Conversion set according to claim 2, characterised in that a central axis of the at least one through hole in each mounting plate runs obliquely and at an angle to the central axis of the corresponding mounting plate so that the opening of the through hole on the inner side of the mounting plate is arranged closer to the edge of the mounting plate than the opening of the through hole on the outer side of the mounting plate.

4. Conversion set according to claim 2, characterised in that at least one further tension means flow director is provided, wherein both tension means flow directors are arranged on oppositely situated sides of the plate packet.

5. Conversion set according to claim 1, characterised in that a central axis of the at least one through hole in each mounting plate runs obliquely and at an angle to the central axis of the corresponding mounting plate so that the opening of the through hole on the inner side of the mounting plate is arranged closer to the edge of the mounting plate than the opening of the through hole on the outer side of the mounting plate.

6. Conversion set according to claim 5, characterised in that at least one further tension means flow director is provided, wherein both tension means flow directors are arranged on oppositely situated sides of the plate packet.

7. Conversion set according to claim 1, characterised in that the tension means flow director has a thickness of at least 5 mm.

8. Conversion set according to claim 7, characterised in that at least one further tension means flow director is provided, wherein both tension means flow directors are arranged on oppositely situated sides of the plate packet.

9. Conversion set according to claim 1, characterised in that at least one further tension means flow director is provided, wherein both tension means flow directors are arranged on oppositely situated sides of the plate packet.

10. Conversion set according to claim 1, characterised in that on the through hole of each mounting plate a first flange is arranged and on each mounting plate a further flange is provided.

11. Conversion set according to claim 1, characterised in that on the through hole of each mounting plate a first pipe weld end is arranged and on each mounting plate a further pipe weld end is provided.

12. Conversion set according to claim 1, characterised in that a support plate is arranged on the inner side of each mounting plate and each mounting plate is in each case connected to the outermost heat exchanger plate of the plate packet by means of the support plate.

13. Conversion set according to claim 1, characterised in that the conversion set comprises at least two plate heat exchanger units, each unit having their mounting plates at their opposite ends, the mounting plates each having thereon a first flange on its respective through hole and a further flange, and the heat exchanger units are connected together by means of the flanges, wherein the mounting plates and the flanges are designed such that they support the weight of the plate heat exchanger units.

14. Conversion set according to claim 1, characterised in that the housing of the tube bundle heat exchanger is a high pressure housing for a pressure range of at least 150 bar.

15. Conversion set according to claim 1, characterised in that at least one further tension means flow director is provided, wherein both tension means flow directors are arranged on oppositely situated sides of the plate packet.

16. Conversion set according to claim 1, characterised in that the conversion set comprises at least two plate heat exchanger units, each unit having their mounting plates at their opposite ends, the mounting plates each having thereon a first pipe weld end on its respective through hole and a further pipe weld end, and the heat exchanger units are connected together by means of the pipe weld ends, wherein the mounting plates and the pipe weld ends are designed such that they support the weight of the plate heat exchanger units.

17. Conversion set according to claim 1, characterised in that the tension means flow director is connected to both the mounting plates by welding.

18. The method of using a plate heat exchanger unit having an outer side having an outer diameter and which has replaced a tube bundle unit in a tube bundle heat exchanger comprising a cylindrical housing having an inner side defining an inner diameter, the outer diameter of the plate heat exchanger unit being adapted to fit within the inner diameter of the cylindrical housing, which plate heat exchanger unit comprises at least the following components:

(a) a plate packet having at least two heat exchanger plates, each comprising at least one through hole and welded to each other in pairs along the periphery thereof or along the periphery of the through holes, (b) a cage comprised of two essentially circular mounting plates joined to at least one tension means flow director which extends in the longitudinal direction between the two mounting plates, the tension means flow director comprising a single structure which is configured to extend at least partially around the periphery of the plate packet and serves both to secure the two mounting plates to each other and to prevent bypass flow of a heat exchange medium past the plate packet, wherein an inner side of the at least one tension means flow director is located on the external diameter of the plate packet and an outer side of the at least one tension means flow director terminates along the outer diameter of the mounting plates, the two mounting plates each having at least one through hole and a recess in the shape of a ring segment at its edge for diverting the flow of a heat transfer medium flowing through the housing of the tube bundle heat exchanger, wherein the recess extends over an angle of approx. 90°, and wherein in each case one of the mounting plates is arranged at each end of the plate packet and is connected to each outermost heat exchanger plate of the plate packet, wherein the at least one tension means flow director is located on either side of the recess, the through holes in the heat exchanger plates and the through holes in the mounting plates forming a first flow channel, and the cage being disposed about the plate packet, said cage by itself being capable of absorbing the forces arising in the plate packet in the operating state of the plate heat exchanger unit, and the inner side of the housing and the outer side of the plate packet forming between them a second flow channel, the method comprising flowing a first heat transfer medium through the first flow channel and flowing a second heat transfer medium through the second flow channel, with the first heat transfer medium being in heat-exchange relationship with the second heat transfer medium to thereby transfer heat between the first heat transfer medium and the second heat transfer medium.

* * * * *